US009016690B2

(12) United States Patent
Fukunaga

(10) Patent No.: US 9,016,690 B2
(45) Date of Patent: Apr. 28, 2015

(54) SHEET CONVEYING DEVICE AND IMAGE FORMING APPARATUS WITH SAME

(71) Applicant: KYOCERA Document Solutions Inc., Osaka-shi, Osaka (JP)

(72) Inventor: Yasuyuki Fukunaga, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/312,197

(22) Filed: Jun. 23, 2014

(65) Prior Publication Data

US 2015/0001791 A1 Jan. 1, 2015

(30) Foreign Application Priority Data

Jun. 26, 2013 (JP) ..... 2013-133455

(51) Int. Cl.

| | |
|---|---|
| ***B65H 5/06*** | (2006.01) |
| ***G03G 21/00*** | (2006.01) |
| ***B65H 5/26*** | (2006.01) |
| ***B65H 7/00*** | (2006.01) |

(52) U.S. Cl.

CPC ..... *G03G 21/00* (2013.01); *B65H 5/068* (2013.01); *B65H 5/26* (2013.01); *B65H 7/00* (2013.01)

(58) Field of Classification Search

USPC ..... 271/273, 274; 399/123, 124, 351

See application file for complete search history.

(56) References Cited

U.S. PATENT DOCUMENTS

| | | | | |
|---|---|---|---|---|
| 6,757,502 | B2 * | 6/2004 | Yoshikawa | 399/22 |
| 7,228,096 | B2 * | 6/2007 | Yamada | 399/323 |
| 7,761,043 | B2 * | 7/2010 | Park | 399/323 |
| 8,280,289 | B2 * | 10/2012 | Yamanaka et al. | 399/323 |
| 2014/0140727 | A1 * | 5/2014 | Shimoi | 399/121 |

FOREIGN PATENT DOCUMENTS

| | | |
|---|---|---|
| JP | 2007-039139 | 2/2007 |
| JP | 2009-143684 | 7/2009 |

* cited by examiner

*Primary Examiner* — Michael McCullough

(74) *Attorney, Agent, or Firm* — Gerald E. Hespos; Michael J. Porco; Matthew T. Hespos

(57) ABSTRACT

A sheet conveying device includes an apparatus main body with a wall portion, a sheet conveyance path, a conveyor roller pair, an opening/closing unit and a cleaning unit. The conveyor roller pair includes a first roller and a second roller. The opening/closing unit is openable and closable relative to the apparatus main body. The opening/closing unit defines a part of the sheet conveyance path and brings the first roller into contact with the second roller in a closed state. The opening/closing unit separates the first roller from the second roller in an open state. The cleaning unit includes a cleaning member and a support frame. The cleaning member cleans a surface of the second roller. The support frame supports the cleaning member and moves the cleaning member toward and away from the surface of the second roller in association with the movements of the opening/closing unit.

11 Claims, 7 Drawing Sheets

SHEET CONVEYING DEVICE AND IMAGE FORMING APPARATUS WITH SAME

This application is based on Japanese Patent Application No. 2013-133455 filed with the Japan Patent Office on Jun. 26, 2013, the contents of which are hereby incorporated by reference.

BACKGROUND

The present disclosure relates to a sheet conveying device for conveying a sheet and an image forming apparatus with the same.

Conventionally, a sheet conveying device for conveying a sheet is known to be provided in an image forming apparatus. A sheet conveying device includes a sheet cassette, a sheet conveyance path extending from the sheet cassette and registration rollers as conveyor rollers. A sheet fed from the sheet cassette is conveyed to an image forming unit of an image forming apparatus after being temporarily stopped at the registration rollers. After an image is formed on the sheet in the image forming unit, the sheet is discharged.

SUMMARY

A sheet conveying device according to one aspect of the present disclosure includes an apparatus main body with a wall portion, a sheet conveyance path, a conveyor roller pair, an opening/closing unit and cleaning unit. The conveyor roller pair includes a first roller and a second roller. The first roller is arranged on the wall portion side with respect to the sheet conveyance path. The second roller is arranged at a side of the sheet conveyance path opposite to the first roller and forms a conveyance nip portion, through which the sheet is conveyed, between the first roller and the second roller. The opening/closing unit rotatably supports the first roller and is openable and closable relative to the apparatus main body on the wall portion side. The opening/closing unit defines a part of the sheet conveyance path and brings the first roller into contact with the second roller in a closed state relative to the apparatus main body. The opening/closing unit separates the first roller from the second roller in an open state relative to the apparatus main body. The cleaning unit cleans the second roller. The cleaning unit includes a cleaning member and a support frame. The cleaning member is arranged to face the second roller and cleans a surface of the second roller. The support frame supports the cleaning member and moves the cleaning member toward and away from the surface of the second roller in association with opening and closing movements of the opening/closing unit.

Further, an image forming apparatus according to another aspect of the present disclosure includes a sheet storage unit, the above sheet conveying device and an image forming station. The sheet storage unit stores sheets. The image forming station forms an image on the sheet conveyed by the conveyor roller pair.

These and other objects, features and advantages of the present disclosure will become more apparent upon reading the following detailed description along with the accompanying drawings.

DETAILED DESCRIPTION

<Description of Image Forming Apparatus>

Figure 1:
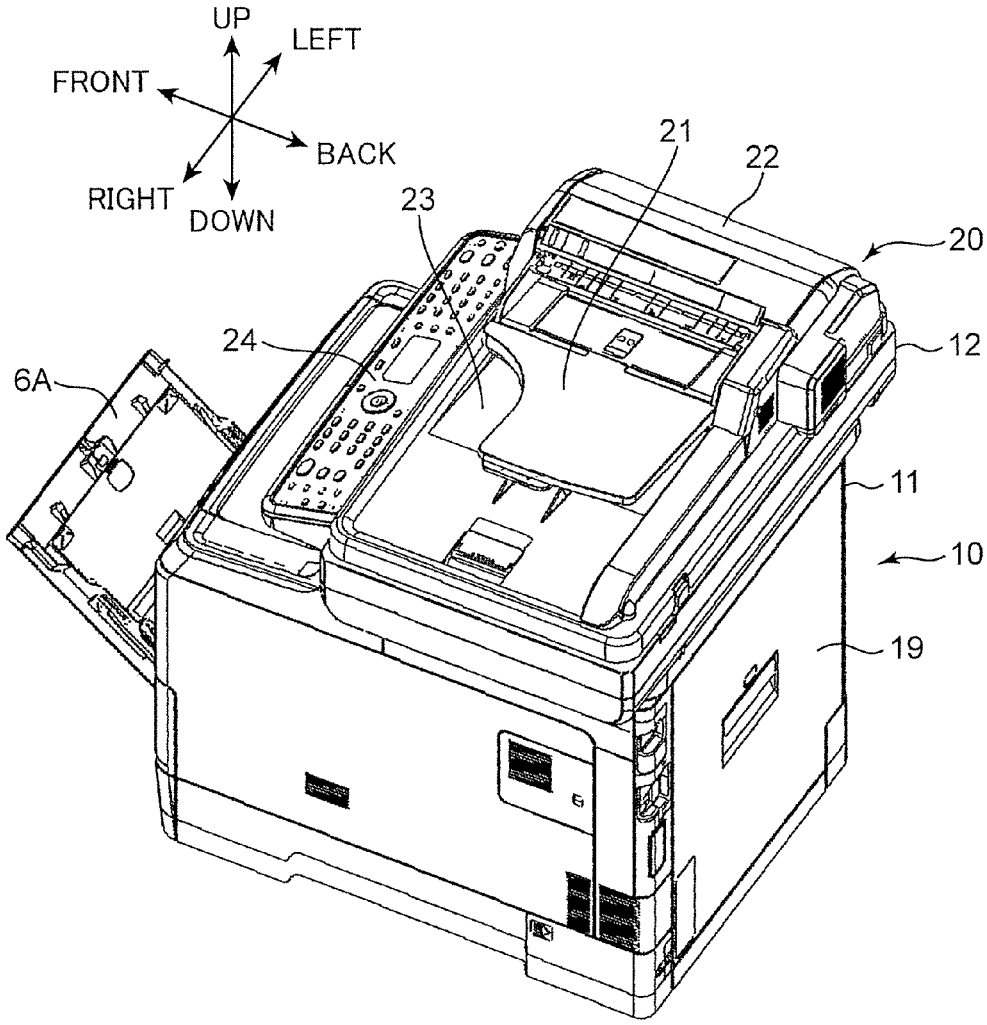
FIG. 1 is a perspective view of an image forming apparatus according to an embodiment of the present disclosure.
Figure 2:
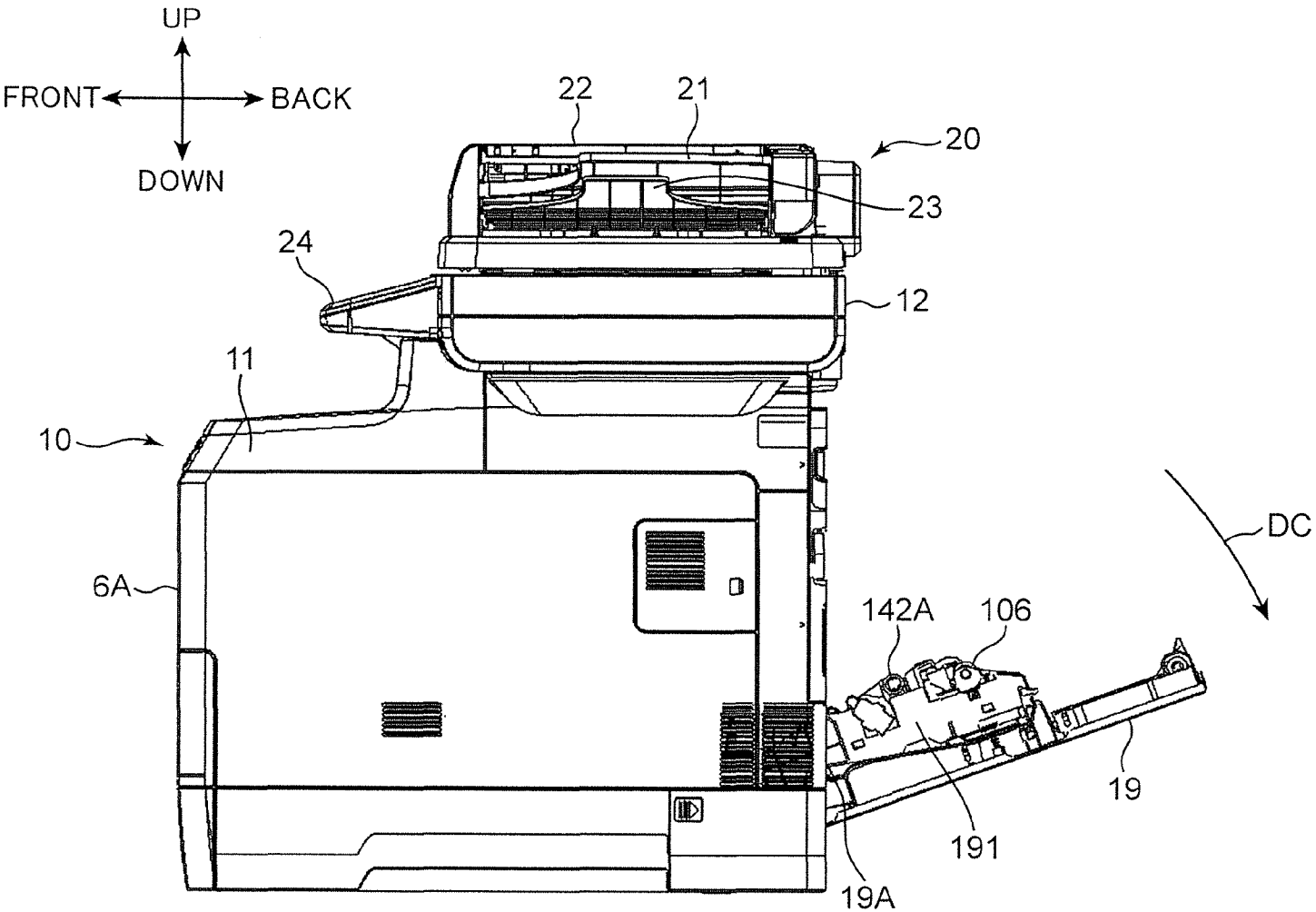
FIG. 2 is a side view of the image forming apparatus according to the embodiment of the present disclosure.
Figure 3:
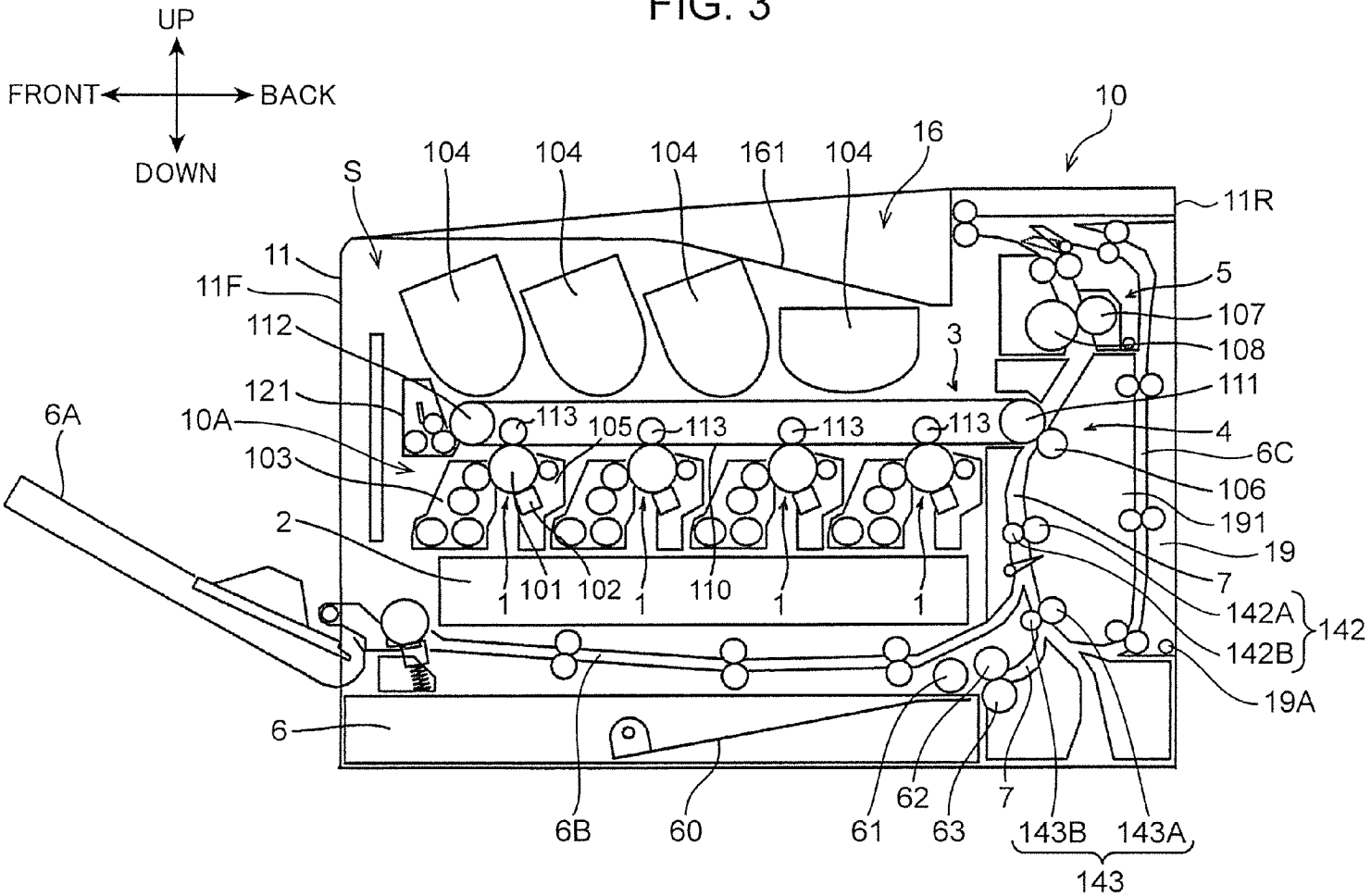
FIG. 3 is a sectional view showing the internal structure of the image forming apparatus according to the embodiment of the present disclosure.
Figure 4:
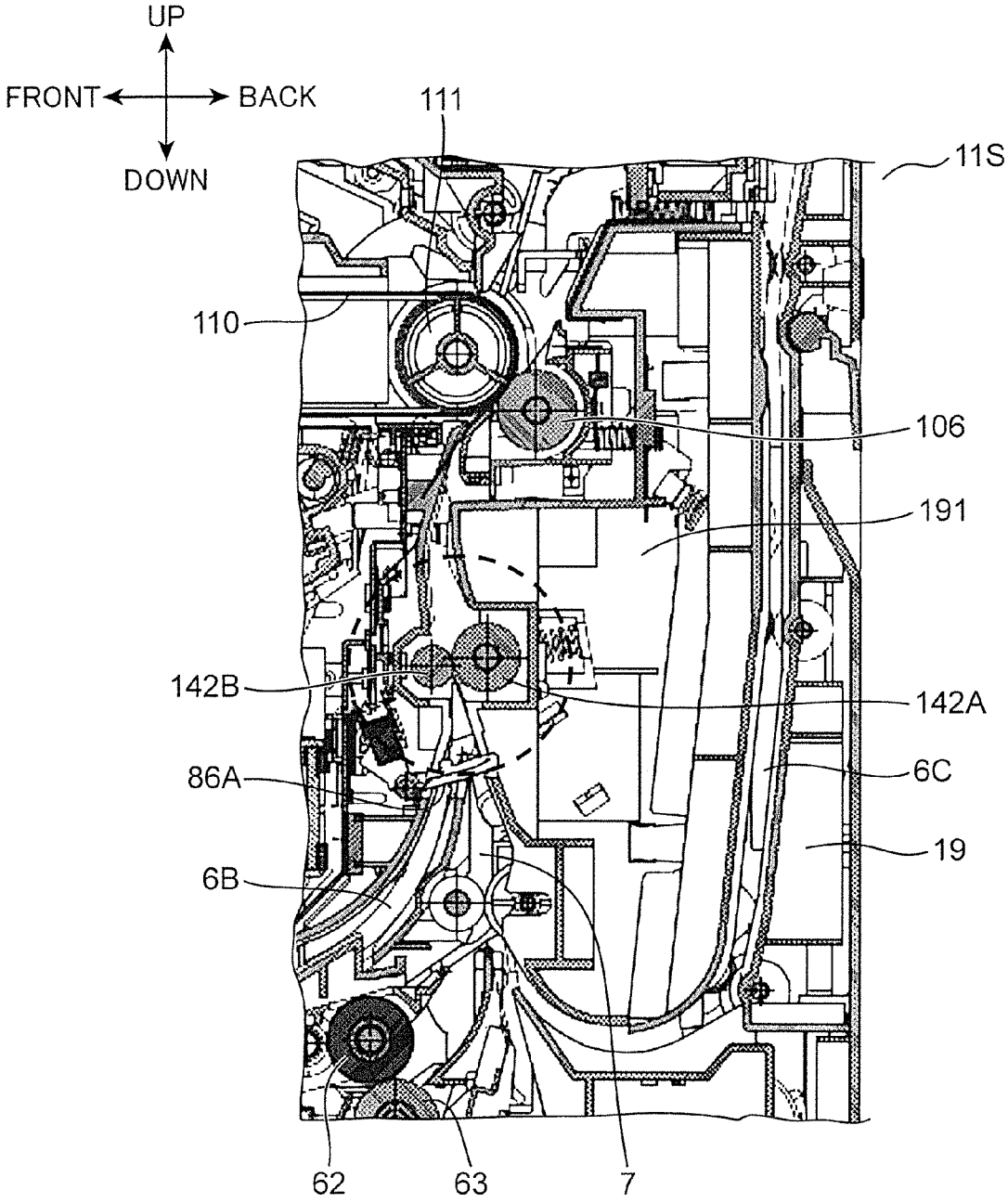
FIG. 4 is an enlarged sectional view of the surrounding of a sheet conveyance path of the image forming apparatus according to the embodiment of the present disclosure.

Hereinafter, an embodiment of the present disclosure is described with reference to the drawings. FIG. 1 is a perspective view of an image forming apparatus 10 according to the embodiment of the present disclosure and FIG. 2 is a side view of the image forming apparatus 10. Note that a state where a cover 19 and a duplex conveying unit 191 to be described later are open is shown in FIG. 2. FIG. 3 is a diagrammatic sectional view showing the internal structure of the image forming apparatus 10. Note that an automatic document feeder 20 is not shown in FIG. 3. Further, FIG. 4 is an enlarged detailed sectional view of the surrounding of a registration roller pair 142 of the image forming apparatus 10. Although a complex machine provided with a printer function and a copier function is illustrated as the image forming apparatus 10 here, the image forming apparatus may be a printer, a copier, a facsimile machine or the like.

The image forming apparatus 10 illustrated in this embodiment is a complex machine of a so-called internal discharge type. The image forming apparatus 10 includes a lower housing (apparatus main body) having a substantially rectangular parallelepipedic shape, and an upper housing 12 and the automatic document feeder 20 arranged above the lower housing 11. The upper housing 12 and the automatic document feeder 20 are arranged above the lower housing 11 while being spaced apart. Further, the image forming apparatus 10 includes an image forming station 10A, a fixing unit 5, a sheet cassette 6 and a sheet discharge portion 16 arranged in the lower housing 11, and an unillustrated image reading unit and an operation unit 24 arranged in and on the upper housing 12. The image forming station 10A forms a toner image (image) on a sheet conveyed from the sheet cassette 6. The image forming unit 10A includes image forming units 1, an exposure device 2, a transfer unit 3 and a secondary transfer portion 4.

The lower housing 11 includes a front wall 11F and a rear wall 11R (wall portion). The front wall 11F is a front wall portion of the lower housing 11. The rear wall 11R is a rear wall portion of the lower housing 11 on a side opposite to the front wall 11F.

The image forming units 1 are respectively arranged in correspondence with toner of a plurality of colors. Each image forming unit 1 forms a toner image on an intermediate transfer belt 110 to be described later. The image forming unit 1 includes a photoconductive drum 101, a charger 102, a developing device 103, a toner container 104 and a cleaning device 105.

The photoconductive drum 101 is driven and rotated. An electrostatic latent image is formed on the circumferential surface of the photoconductive drum 101. Further, the photoconductive drum 101 carries a toner image. The charger 102 uniformly charges the circumferential surface of the photoconductive drum 101. The developing device 103 supplies the toner to the circumferential surface of the photoconductive drum 101. The toner container 104 supplies replenishing toner to the developing device 103. The cleaning device 105 cleans the circumferential surface of the photoconductive drum 101 after the primary transfer of the toner to the intermediate transfer belt 110.

The exposure device 2 forms an electrostatic latent image corresponding to image data on the photoconductive drum 101 of each color. The transfer unit 3 includes the intermediate transfer belt 110, a drive roller 111, a driven roller 112, primary transfer rollers 113 and a belt cleaner 121. The intermediate transfer belt 110 carries toner images primarily transferred from the photoconductive drums 101. The toner images are transferred in a superimposed manner on a surface of the intermediate transfer belt 110 from the photoconductive drums 101 of the respective colors. The intermediate transfer belt 110 is so supported by the drive roller 111 and the driven roller 112 as to be rotationally movable. The drive roller 111 transmits a rotational drive force to the intermediate transfer belt 110 and forms a secondary transfer nip portion together with a secondary transfer roller 106 to be described later. The driven roller 112 rotates, following the rotation of the intermediate transfer belt 110. The primary transfer rollers 113 are arranged to face the photoconductive drums 101 of the respective colors with the intermediate transfer belt 110 held therebetween. The primary transfer roller 113 primarily transfers the toner image on the photoconductive drum 101 to the intermediate transfer belt 110. The belt cleaner 121 cleans the surface of the intermediate transfer belt 110 after the secondary transfer.

The secondary transfer portion 4 transfers a toner image on the intermediate transfer belt 110 to a sheet. The secondary transfer portion 4 includes the secondary transfer roller 106. The secondary transfer roller 106 is arranged to face the drive roller 111. A secondary transfer bias is applied to the secondary transfer roller 106 to transfer the toner image on the intermediate transfer belt 110 to the sheet.

The fixing unit 5 includes a fixing roller 108 internally provided with an electric heating element such as a halogen lamp and a pressure roller 107 arranged to face the fixing roller 108. A sheet fed from the secondary transfer portion 4 receives heat while passing through a nip portion between these fixing roller 108 and pressure roller 107, whereby the toner image is fixed.

The sheet cassette 6 stores a plurality of sheets. When an image forming process is performed, the sheets are picked up one by one from the sheet cassette 6 to the sheet conveyance path 7 and fed to the secondary transfer portion 4, whereby the image forming process (printing process) is performed on this sheet. The sheet cassette 6 is detachably mountable into the lower housing 11. The sheet cassette 6 includes a lift plate 60. The lift plate 60 is arranged in the sheet cassette 6. The sheets are stacked on the upper surface of the lift plate 60. By moving a rear end side of the lift plate 60 upward, the leading end edge of the sheet comes into contact with a pickup roller 61.

The lower housing 11 includes the pickup roller 61, a feed roller 62 and a retard roller 63. The pickup roller 61 is arranged above the leading end edges of the sheets (end edges on a rear side). The pickup roller 61 is driven and rotated to feed the sheet toward the feed roller 62. The feed roller 62 is arranged at a distance from and downstream of the pickup roller 61 in a feeding direction. The feed roller 62 further conveys the sheet fed by the pickup roller 61 toward the sheet conveyance path 7. The retard roller 63 is arranged to face the feed roller 62 and forms a feeding nip portion between the feed roller 62 and the retard roller 63. The sheets are separated by the retard roller 63, so that the uppermost one of the stacked sheets is conveyed toward the sheet conveyance path 7.

Further, the sheet conveyance path 7 vertically extends at the inner side of the rear wall 11R in the lower housing 11. The sheet conveyance path 7 extends upward along the inner side of the rear wall 11R from the sheet cassette 6. The sheet conveyance path 7 extends through the secondary transfer portion 4 to convey the sheet in a predetermined conveying direction.

Further, the lower housing 11 includes a registration roller pair 142 and a sheet conveyor roller pair 143.

The registration roller pair 142 (conveyor roller pair) is arranged upstream of the secondary transfer portion 4 in the sheet conveying direction. The leading end edge of the sheet is temporarily stopped at the registration roller pair 142. At this time, the oblique feed of the sheet is corrected. In accordance with an image formation timing in the image forming station 10A, the registration roller pair 142 conveys the sheet. The registration roller pair 142 includes a registration driven roller 142A (first roller) and a registration roller 142 (second roller) (FIGS. 3 and 4). The registration driven roller 142A is arranged on a side of the sheet conveyance path 7 near the rear wall 11R. The registration roller 142B is arranged on a side of the sheet conveyance path 7 opposite to the registration driven roller 142A. A registration nip portion (conveying nip portion) through which the sheet passes is formed between the registration driven roller 142A and the registration roller 142B. The registration driven roller 142A is rotatably supported in the duplex conveying unit 191. Further, the registration roller 142B is rotatably supported in the lower housing 11.

The sheet conveyor roller pair 143 is arranged upstream of the registration roller pair 142 in the conveying direction. The sheet conveyor roller pair 143 conveys a sheet conveyed from the sheet cassette 6 or a reverse conveyance path 6C to be described later toward the registration roller pair 142. The sheet conveyor roller pair 143 includes a first conveyor roller 143A and a second conveyor roller 143B. A nip portion through which the sheet passes is formed between the first and second conveyor rollers 143A, 143B. The first conveyor roller 143A is rotatably supported in the duplex conveying unit 191 to be described later. The second conveyor roller 143B is rotatably supported in the lower housing 11.

The sheet discharge portion 16 is formed by recessing a part of the upper surface of the lower housing 11 below the upper housing 12. An internal discharge portion is arranged between the lower housing 11 and the upper housing 12.

The unillustrated image reading unit is arranged in the upper housing 12. The image reading unit includes an unillustrated contact glass on which a document is to be placed and an unillustrated scanning mechanism for scanning an image of a document placed on the contact glass. Analog information of the document image read by the scanning mechanism is output toward the exposure device 2 and subjected to the image forming process after being converted into a digital signal.

The automatic document feeder 20 feeds a document to a reading position on the contact glass. With reference to FIG. 2, a front end side of the automatic document feeder 20 is vertically rotated with a rear end side thereof as a supporting point. At this time, the automatic document feeder 20 has a function of pressing a document placed on the contact glass.

The automatic document feeder 20 includes a document tray 21, a document feeding unit 22 and a document discharge tray 23. Documents are placed on the document tray 21. The document feeding unit 22 feeds the documents placed on the document tray 21 one by one to the document reading position on the contact glass. Thereafter, the documents are discharged to the document discharge tray 23.

The operation unit 24 projects forward from a front surface part of the upper housing 12. The operation unit 24 is for entering process information on the image forming process and includes an unillustrated numerical keypad for entering the number of sheets to be processed and the like, various other operation keys, an unillustrated LCD (Liquid Crystal Display) for touch input and the like.

Further, a manual feed tray 6A is attached at a position of the front wall 11F of the lower housing 11 right above the sheet cassette 6. This manual feed tray 6A is rotatably supported about a lower end part thereof and displaceable between a closing posture where it stands to close a manual sheet feed opening and an opening posture where it projects forward. This manual feed tray 6A is used for manual sheet feed when being set in the opening posture. A manual conveyance path 6B extends between such a manual feed tray 6A and the sheet conveyance path 7. The manual conveyance path 6B extends from the manual feed tray 6A toward the rear wall 11R through the interior of the lower housing 11. A sheet is carried into the sheet conveyance path 7 while being conveyed in the manual conveyance path 6B.

Further, the lower housing 11 includes the cover 19 (cover unit) and the duplex conveying unit 191 (opening/closing unit). The cover 19 is arranged on the rear wall 11R of the lower housing 11. The cover 19 is openable and closable relative to the lower housing 11, forms a part of the rear wall 11R in a closed state and exposes the duplex conveying unit 191 to the outside of the lower housing 11 in an open state. Specifically, as shown in FIG. 3, an upper end side of the cover 19 is rotated backward (arrow DC of FIG. 2) with a cover rotary shaft 19A arranged on a lower end part of the cover 19 as a supporting point. As a result, the cover 19 can be opened and closed relative to the lower housing 11. Further, the cover 19 defines a wall surface on the side of the rear wall 11R out of the reverse conveyance path 6C to be described later.

The duplex conveying unit 191 is arranged before the cover 19. The duplex conveying unit 191 is openable and closable relative to the lower housing 11 on the side of the rear wall 11R of the lower housing 11. The duplex conveying unit 191 is openable relative to the lower housing 11 integrally with the cover 19. Further, the duplex conveying unit 191 is openable relative to the lower housing 11 independently of the cover 19. An upper end side of the duplex conveying unit 191 is rotated backward (arrow DC of FIG. 2) with an unillustrated rotary shaft arranged on a lower end side of the duplex conveying unit 191 as a supporting point. As a result, the duplex conveying unit 191 can be opened and closed relative to the lower housing 11. The duplex conveying unit 191 defines a front wall surface of the reverse conveyance path 6C. Further, the duplex conveying unit 191 defines a rear wall surface of the sheet conveyance path 7. Further, the duplex conveying unit 191 rotatably supports the registration driven roller 142A. The duplex conveying unit 191 defines a part of the sheet conveyance path 7 and brings the registration driven roller 142A into contact with the registration roller 142B in a closed state relative to the lower housing 11. Further, the duplex conveying unit 191 separates the registration driven roller 142A from the registration roller 142B and exposes the registration roller 142B to the outside of the lower housing 11 in an open state relative to the lower housing 11. Note that a sheet conveying unit 11S (FIG. 4) (sheet conveying device) of this embodiment is formed by the sheet conveyance path 7, the registration roller pair 142, the duplex conveying unit 191 and a paper powder collection unit 8 including a cleaning member 83 to be described later arranged in the lower housing 11. The sheet conveying unit 11S conveys a sheet through the secondary transfer portion 4.

A sheet after a fixing process is discharged to the sheet discharge portion 16 via a discharge conveyance path provided above the fixing unit 5 if the sheet is for simplex printing. On the other hand, if printing is applied to the other side of the sheet after the fixing process for duplex printing, the sheet having an image formed on one side is carried into the secondary transfer portion 4 again via the reverse conveyance path 6C provided behind the sheet conveyance path 7. The reverse conveyance path 6C is formed between the cover 19 and the duplex conveying unit 191 in the closed state. The reverse conveyance path 6C carries the sheet having the image formed on one side in the secondary transfer portion 4 to a side of the sheet conveyance path 7 upstream of the secondary transfer portion 4 in the conveying direction. Thereafter, the sheet is fed to the secondary transfer portion 4 again to form an image on the other side. The sheet finished with the duplex printing is discharged to the sheet discharge portion 16.

In this embodiment, a sheet jammed in the reverse conveyance path 6C can be removed by opening the cover 19 relative to the lower housing 11. Further, a sheet jammed in the sheet conveyance path 7 can be removed and maintenance for the registration roller pair 142 is possible by opening the duplex conveying unit 191 relative to the lower housing 11.

Figure 5B:
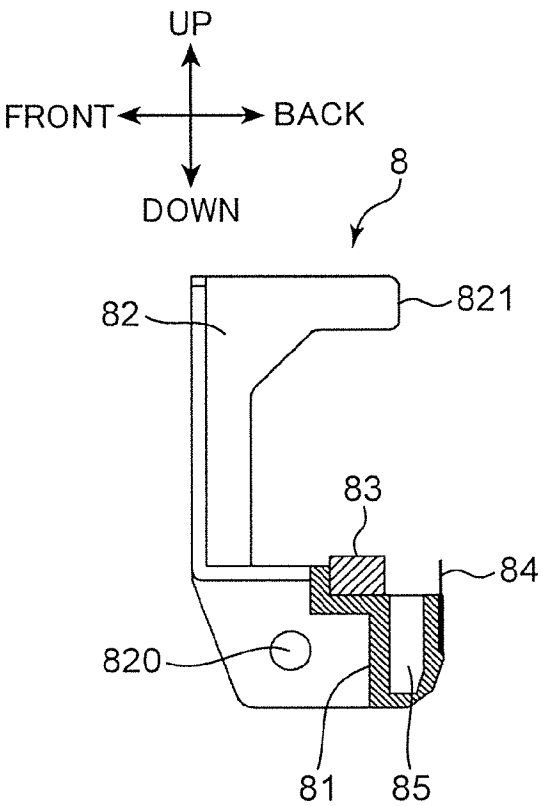
FIGS. 5A and 5B are a perspective view and a sectional view of a cleaning unit according to the embodiment of the present disclosure.
Figure 5A:
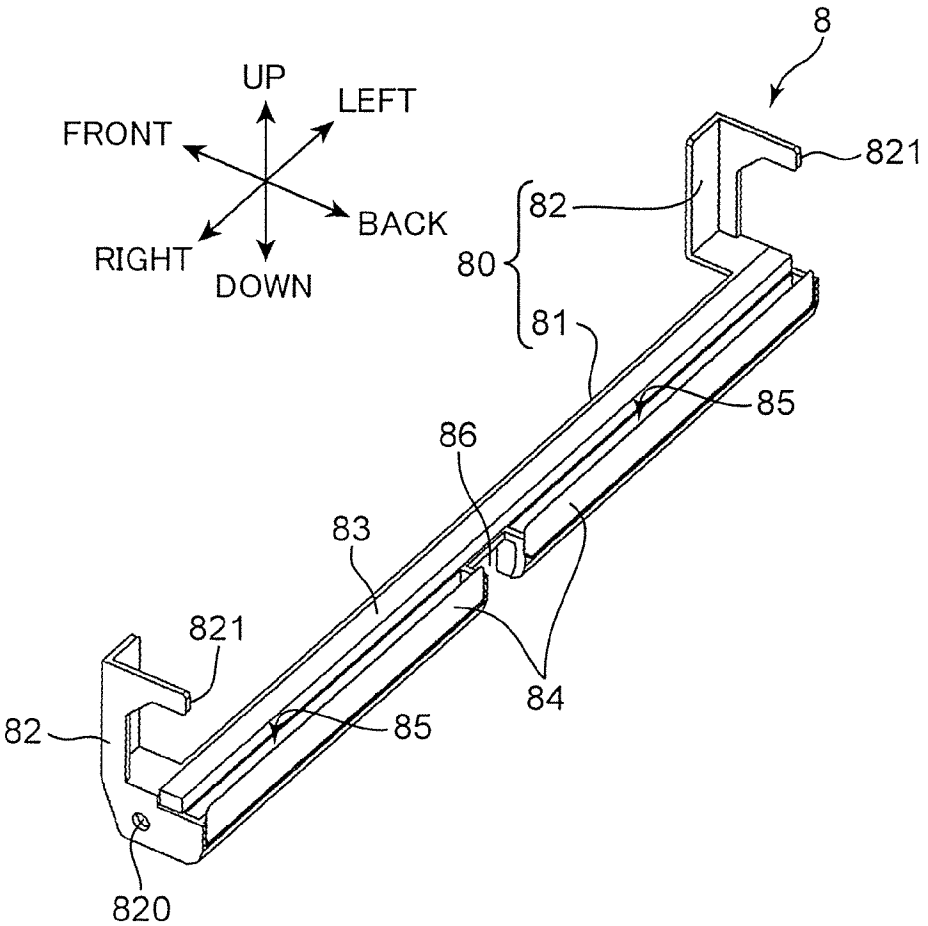
Figure 6:
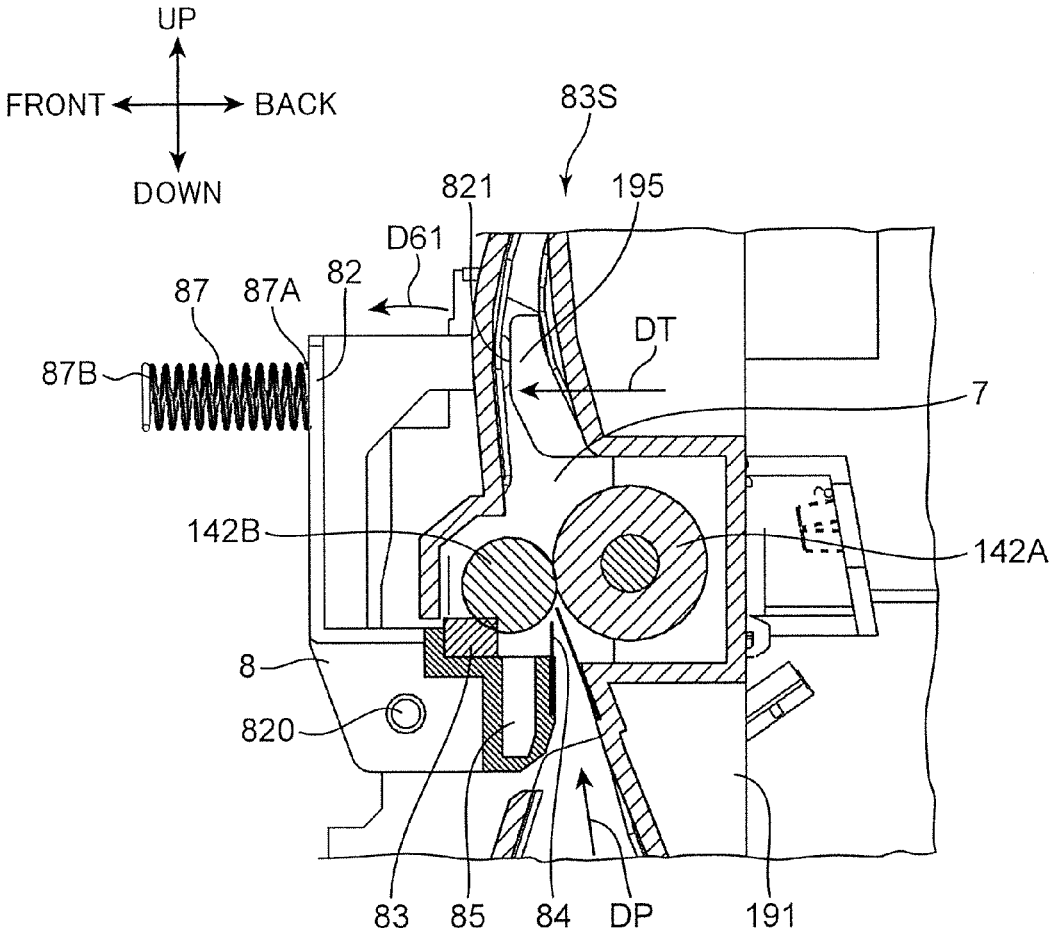
FIG. 6 is a sectional view of the surrounding of the cleaning unit in a closed state of an opening/closing unit according to the embodiment of the present disclosure.
Figure 7:
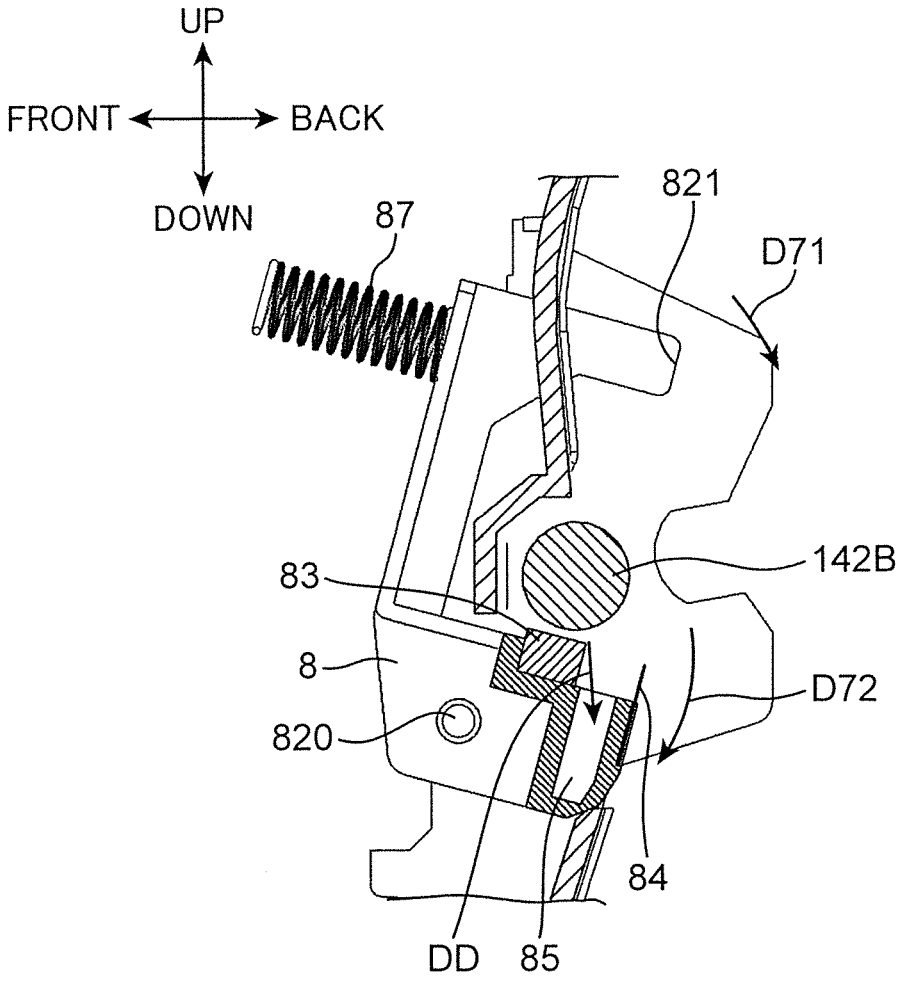
FIG. 7 is a sectional view of the surrounding of the cleaning unit in an open state of the opening/closing unit according to the embodiment of the present disclosure.

Next, a cleaning mechanism for the registration roller 142B according to this embodiment is described with reference to FIGS. 5 to 7. FIGS. 5A and 5B are a perspective view and a sectional view of the paper powder collection unit 8 according to this embodiment. FIG. 6 is a sectional view of the surrounding of the paper powder collection unit 8 in the closed state of the duplex conveying unit 191. FIG. 7 is a sectional view of the surrounding of the paper powder collection unit 8 in the open state of the duplex conveying unit 191.

With reference to FIGS. 5A, 5B and 6, the sheet conveying unit 11S (the sheet conveying device) includes the cleaning member 83. The cleaning member 83 is arranged to face the registration roller 142B and cleans a surface of the registration roller 142B. As described above, a sheet comes into contact with the registration roller pair 142 including the registration roller 142B and the conveyance thereof is temporarily stopped. At this time, paper powder from the sheet is likely to adhere to the registration roller 142B. If much paper powder adheres to the surface of the registration roller 142B, the conveyance performance of the registration roller 142B is reduced. Further, if the paper powder removed from the registration roller 142B by the contact of the cleaning member 83 with the surface of the registration roller 142B is caught between the cleaning member 83 and the registration roller 142B for a long time, it similarly causes a rotation failure of the registration roller 142B and a reduction in sheet conveyance performance.

In this embodiment, to solve the above problem, the cleaning member 83 can be separated from the surface of the registration roller 142B. Specifically, the sheet conveying unit 11S includes the paper powder collection unit 8 (FIGS. 5A, 5B and 6) (cleaning unit). The paper powder collection unit 8 includes the aforementioned cleaning member 83 and a support frame 80 (FIG. 5A). The support frame 80 supports the cleaning member 83 and moves the cleaning member 83 toward and away from the surface of the registration roller 142B in association with opening and closing movements of the duplex conveying unit 191. The support frame 80 brings the cleaning member 83 into contact with the surface of the registration roller 142B in the closed state of the duplex conveying unit 191 and separates the cleaning member 83 from the surface of the registration roller 142B in the open state of the duplex conveying unit 191. A mechanism for moving the cleaning member 83 by the support frame 80 is defined as a moving unit 83S.

The support frame 80 is a frame extending in an axial direction (lateral direction) of the registration roller 142B. The support frame 80 is arranged to face the registration roller 142B at a front side of the registration roller 142B. The support frame 80 includes a unit main body 81 (frame main body), unit side walls 82 (side walls), guide sheets 84 and collectors 85.

The unit main body 81 is a main body part of the support frame 80. With reference to FIG. 5B, a rear part of the unit main body 81 has a substantially U shape open upward in a cross-section intersecting with the axial direction. Further, the cleaning member 83 is fixed to the upper surface of the front part of the unit main body 81. Further, the rear surface of the unit main body 81 serves as a conveyance guide surface defining the sheet conveyance path 7 in which a sheet is conveyed (see FIG. 6).

The unit side walls 82 are a pair of side walls arranged on opposite left and right end parts of the unit main body 81. In the above cross-section, the unit side wall 82 has a substantially U shape open backward. In other words, the unit side walls 82 have the substantially U shape open backward by being bent backward after projecting forward from the opposite end parts of the unit main body 81 and bent upward. As shown in FIG. 6, the registration roller 142B is arranged in the U-shaped interiors of the unit side walls 82. Specifically, in the above cross-section, the unit side wall 82 is arranged to surround the registration roller 142B. The unit side wall 82 includes a supporting point portion 820 and an abutting portion 821.

The supporting point portions 820 respectively extend in the axial direction of the registration roller 142B on lower end parts of the pair of unit side walls 82. In this embodiment, the supporting point portions 820 are respectively holes on the unit side walls 82. A pair of unillustrated shaft portions arranged on the lower housing 11 are inserted into the supporting point portions 820. The supporting point portions 820 are rotatably supported in the lower housing 11. As a result, the paper powder collection unit 8 is rotatable about the supporting point portions 820.

The abutting portions 821 are respectively arranged on upper and back end parts of the pair of unit side walls 82. In other words, the abutting portions 821 are a pair of projecting pieces projecting backward and facing the duplex conveying unit 191 on opposite end parts of the support frame 80 in the lateral direction. Note that the abutting portion 821 may be arranged only on one of the left and right end parts in another embodiment.

The cleaning member 83 is a sponge member in the form of a rectangular column extending in the axial direction of the registration roller 142B. The cleaning member 83 comes into contact with the surface of the registration roller 142B from below the registration roller 142B. Specifically, the cleaning member 83 comes into contact with the surface of the registration roller 142B from a lower front side of the registration roller 142B. At this time, one corner part of the cleaning member 83 comes into contact with the surface of the registration roller 142B.

The guide sheets 84 are arranged on the unit main body 81 of the support frame 80 between the collectors 85 and the sheet conveyance path 7 (FIG. 6). As shown in FIG. 5B, the guide sheets 84 are fixed to a wall portion (conveyance guide surface or side surface portion) facing the sheet conveyance path 7 on a rear end side of the unit main body 81. The guide sheets 84 are adhered to the conveyance guide surface to extend toward the registration roller pair 142 from this guide surface. The guide sheets 84 guide the sheet toward the registration roller pair 142. In this embodiment, the guide sheets 84 are sheet members such as PET films. Particularly, lower end parts of the guide sheets 84 as fixed ends are fixed to the wall portion of the unit main body 81 and tip parts thereof as free ends extend toward the surface of the registration roller 142B from the unit main body 81. Further, the guide sheets 84 have a sealing function of suppressing the leakage of foreign substances such as paper powder collected by the cleaning member 83 toward the sheet conveyance path 7. Note that, as shown in FIG. 5A, there are two guide sheets 84 separated in the axial direction (lateral direction) and the unit main body 81 is partly cut off to form a retracted portion 86 between the two guide sheets 84 in the axial direction. As shown in FIG. 4, the retracted portion 86 is a space where an actuator 86A is arranged to project into the sheet conveyance path 7. The actuator 86A detects the sheet in the sheet conveyance path 7. According to this detection result, the rotation of the registration roller pair 142 is controlled by an unillustrated controller.

The collectors 85 are arranged on a rear part of the unit main body 81 of the support frame 80. As shown in FIGS. 5A and 5B, the collectors 85 are spaces formed by recessing parts of the unit main body 81 downward between the cleaning member 83 and the conveyance guide surface (rear surface of the unit main body 81). The collectors 85 are arranged closer to the sheet conveyance path 7 than the cleaning member 83. Further, with reference to FIG. 6, the collectors 85 are arranged below the registration roller 142B. Collected substances such as paper powder removed by the cleaning member 83 fall down from the registration roller 142 to be collected by the collectors 85. Note that since the cleaning member 83 for cleaning the surface of the registration roller 142B and the collectors 85 for collecting foreign substances and paper powder are arranged in the paper powder collection unit 8, the cleaning mechanism for the registration roller 142B is made compact.

With reference to FIG. 6, the arrangement of the registration roller 142B, the abutting portions 821, the cleaning member 83 and the supporting point portions 820 in the closed state of the duplex conveying unit 191 is additionally described. The supporting point portions 820 are arranged below the registration roller 142B and cleaning member 83. Further, the supporting point portions 820 are arranged before the registration roller 142B, i.e. at a position more distant from the duplex conveying unit 191 than the registration roller 142B in a horizontal direction. The abutting portions 821 are arranged above the registration roller 142B. Further, tip parts (rear end parts) of the abutting portions 821 are arranged substantially above a center of rotation of the registration roller 142B. The center of rotation of the registration roller 142B, the cleaning member 83 and the supporting point portions 820 are arranged in this order to be more distant from the registration driven roller 142A in the horizontal direction.

Contact portions 195 (FIG. 6) are arranged in the duplex conveying unit 191. The contact portions 195 are projecting pieces projecting forward (toward the paper powder collection unit 8) from the duplex conveying unit 191. Note that the contact portions 195 are arranged to face the abutting portions 821 of the paper powder collection unit 8 and can come into contact with the abutting portions 821 in the lateral direction perpendicular to the plane of FIG. 6. Specifically, the contact portions 195 are respectively arranged on opposite left and right end parts of the duplex conveying unit 191. The contact portions 195 have a function of rotating the support frame 80 in a first direction (arrow D61 of FIG. 6) about the supporting point portions 820 by coming into contact with the abutting portions 821.

The sheet conveying unit 11S further includes biasing springs 87. The biasing springs 87 are arranged in a compressed state between the front surfaces of the unit side walls 82 and an unillustrated wall portion in the lower housing 11. With reference to FIG. 6, a spring contact portion 87A which is a rear end part of the biasing spring 87 is fixed to the front surface of the unit side wall 82. On the other hand, a spring fixing portion 87B which is a front end part of the biasing spring 87 is fixed to the wall portion of the lower housing 11. The biasing springs 87 have a function of biasing the support frame 80 in a second direction (arrow D71 of FIG. 7) opposite to the first direction about the supporting point portions 820. Note that coil springs arranged around the supporting point portions 820 may be used as biasing members replacing the biasing springs 87 in another embodiment.

Next, with reference to FIGS. 6 and 7, the operation of the paper powder collection unit 8 is described. When the state of the duplex conveying unit 191 changes from the open state to the closed state relative to the lower housing 11 as shown in FIG. 6 from the state of FIG. 7, the contact portions 195 of the duplex conveying unit 191 press the abutting portions 821 (arrow DT of FIG. 6) and the support frame 80 rotates in the first direction about the supporting point portions 820 (arrow D61 of FIG. 6). As a result, the cleaning member 83 comes into contact with the surface of the registration roller 142B from below. When the registration roller 142B is rotated counterclockwise by an unillustrated driver in FIG. 6, the registration driven roller 142A is rotated clockwise, following the rotation of the registration roller 142B. As a result, a sheet is conveyed toward the secondary transfer portion 4 of the image forming station 10A (arrow DP of FIG. 6) while passing through the registration roller pair 142. At this time, with the rotation of the registration roller 142B, foreign substances and paper powder adhering to the surface of the registration roller 142B are scraped off and removed by the cleaning member 83. Further, the sheet is suitably guided toward the registration roller pair 142 by the guide sheets 84 arranged in the paper powder collection unit 8. Thus, the paper powder collection unit 8 as the cleaning mechanism for the registration roller 142B can also have a function of guiding the sheet. Further, since the guide sheets 84 extend to the vicinity of the surface of the registration roller 142B, the scattering of the foreign substances and paper powder collected by the cleaning member 83 toward the sheet conveyance path 7 is suppressed by the guide sheets 84.

On the other hand, when the state of the duplex conveying unit 191 is changed from the closed state to the open state relative to the lower housing 11 as shown in FIG. 7 from the state of FIG. 6 by a user of the image forming apparatus 10 after the image forming process is finished, the contact portions 195 are separated backward from the abutting portions 821 and the support frame 80 is rotated in the second direction about the supporting point portions 820 (arrow D71 of FIG. 7) by a biasing force of the biasing springs 87. As a result, the cleaning member 83 is separated downward from the surface of the registration roller 142B. Thus, the foreign substances and paper powder caught between the cleaning member 83 and the surface of the registration roller 142B fall down. Therefore, a reduction in the conveyance performance of the registration roller pair 142 due to the hindered rotation of the registration roller 142B by the caught foreign substances and paper powder is suppressed. Note that, in this embodiment, the biasing springs 87 bias the support frame 80 in the second direction as described above. Thus, the support frame 80 is reliably rotated in the second direction when the duplex conveying unit 191 is opened. Therefore, the cleaning member 83 can be reliably separated from the surface of the registration roller 142B.

Further, in this embodiment, the supporting point portions 820 and the abutting portions 821 are arranged at vertically opposite sides of the registration roller 142B. Thus, the paper powder collection unit 8 (moving unit 83S) can be arranged in a compact manner utilizing a space around the registration roller 142B. Further, when the cleaning member 83 is separated downward from the surface of the registration roller 142B, the foreign substances and paper powder caught between the cleaning member 83 and the registration roller 142B freely fall down to be separated from the registration roller 142*b* (arrow DD of FIG. 7). The foreign substances and paper powder separated from the registration roller 142B are stably collected into the collectors 85 arranged below. At this time, since the collectors 85 are arranged closer to the sheet conveyance path 7 than the cleaning member 83, the foreign substances and paper powder separated from the registration roller 142B can be reliably collected into the collectors 85 with the rotation of the paper powder collection unit 8 about the supporting point portions 820. Additionally, the supporting point portions 820 are arranged before the cleaning member 83 as described above. Thus, when the paper powder collection unit 8 rotates about the supporting point portions 820, the cleaning member 83 is so inclined that a rear end side of the upper end surface of the cleaning member 83 having a rectangular column shape is lowered. As a result, the collection of the foreign substances and paper powder into the collectors 85 is promoted.

Further, in this embodiment, the guide sheets 84 extending to the vicinity of the surface of the registration roller 142B also move downward (arrow D72 of FIG. 7) with the rotation of the paper powder collection unit 8. Thus, the user can suck the foreign substances and paper powder collected into the collectors 85 by a cleaner or the like via the sheet conveyance path 7 (FIG. 3) opened by the duplex conveying unit 191.

Although the sheet conveying unit 11S and the image forming apparatus 10 provided with the same according to the embodiment of the present disclosure have been described above, the present disclosure is not limited to this. For example, the following modifications can be adopted.

(1) Although the cover 19 is arranged closer to the rear wall 11R than the duplex conveying unit 191 in the above embodiment, the present disclosure is not limited to this. Specifically, in another embodiment, the image forming apparatus may include an opening/closing unit equivalent to the sheet conveyance path 7 and the duplex conveying unit 191 without including the cover 19 and the reverse conveyance path 6C. Even in this case, the cleaning member 83 can be separated from the registration roller 142B by rotating the paper powder collection unit 8 according to the rotation of the opening/closing unit.

(2) Although the abutting portions 821 are arranged above the registration roller 142B and the supporting point portions 820 are arranged below the registration roller 142B in the above embodiment, the present disclosure is not limited to this. Another configuration for moving the cleaning member 83 toward and away from the registration roller 142B according to the opening and closing movements of the duplex conveying unit 191 may be adopted for the sheet conveying unit 11S and the image forming apparatus 10.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A sheet conveying device, comprising:

an apparatus main body with a wall portion;

a sheet conveyance path extending at an inner side of the wall portion in the apparatus main body and configured to convey a sheet in a predetermined conveying direction;

a conveyor roller pair including a first roller arranged on the wall portion side with respect to the sheet conveyance path and a second roller arranged at a side of the sheet conveyance path opposite to the first roller and forming a conveyance nip portion, through which the sheet is conveyed, between the first roller and the second roller;

an opening/closing unit configured to rotatably support the first roller, the opening/closing unit being openable and closable relative to the apparatus main body on the wall portion side, and configured to define a part of the sheet conveyance path and bring the first roller into contact with the second roller in a closed state relative to the apparatus main body and separate the first roller from the second roller in an open state relative to the apparatus main body; and a cleaning unit configured to clean the second roller and including:

a cleaning member arranged to face the second roller and configured to clean a surface of the second roller; and a support frame configured to support the cleaning member and move the cleaning member toward and away from the surface of the second roller in association with opening and closing movements of the opening/closing unit.

2. A sheet conveying device according to claim 1, wherein:

the support frame includes:

a frame main body arranged to face the second roller and configured to support the cleaning member;

a supporting point portion extending along an axial direction of the second roller and rotatably supported in the apparatus main body;

a side wall provided at an end part of the frame main body in the axial direction; and an abutting portion provided on the side wall to face the opening/closing unit;

the opening/closing unit includes a contact portion arranged to be able to come into contact with the abutting portion;

the contact portion presses the abutting portion and the support frame rotates in a first direction about the supporting point portion as the state of the opening/closing unit changes from the open state to the closed state, whereby the cleaning member comes into contact with the surface of the second roller; and the contact portion is separated from the abutting portion and the support frame rotates in a second direction opposite to the first direction about the supporting point portion as the state of the opening/closing unit changes from the closed state to the open state, whereby the cleaning member is separated from the surface of the second roller.

3. A sheet conveying device according to claim 2, further comprising a biasing member configured to bias the support frame in the second direction about the supporting point portion.

4. A sheet conveying device according to claim 2, wherein:

the sheet conveyance path extends upward from below;

the cleaning member comes into contact with the surface of the second roller from below the second roller; and the supporting point portion is arranged below the cleaning member and the abutting portion is arranged above the second roller.

5. A sheet conveying device according to claim 4, wherein:

the cleaning unit further includes a collector arranged below the second roller and configured to collect collected substances removed from the second roller by the cleaning member; and the supporting point portion is arranged at a position more distant from the opening/closing unit than the second roller in a horizontal direction.

6. A sheet conveying device according to claim 5, wherein the collector is arranged in the frame main body of the support frame.

7. A sheet conveying device according to claim 6, wherein the collector is arranged closer to the sheet conveyance path than the cleaning member.

8. A sheet conveying device according to claim 6, wherein the frame main body includes a side surface portion facing the sheet conveyance path, the cleaning unit further includes a guide member arranged in the frame main body along the side surface portion and configured to guide the sheet toward the conveyor roller pair.

9. A sheet conveying device according to claim 8, wherein the guide member is a sheet member extending from the side surface portion of the frame main body toward the surface of the second roller.

10. An image forming apparatus, comprising:

a sheet storage unit configured to store sheets;

a sheet conveying device according to claim 1; and an image forming station configured to form an image on the sheet conveyed by the conveyor roller pair.

11. An image forming apparatus according to claim 10, further comprising:

a cover unit openable and closable relative to the apparatus main body and configured to form a part of the wall portion in a closed state and expose the opening/closing unit to the outside of the apparatus main body in an open state; and a reverse conveyance path formed between the cover unit and the opening/closing unit in the closed state and configured to carry the sheet having the image formed in the image forming station to a side of the sheet conveyance path upstream of the image forming station in the conveying direction.

* * * * *